United States Patent [19]

Bozec

[11] Patent Number: 4,653,277

[45] Date of Patent: Mar. 31, 1987

[54] CONNECTION BETWEEN A STEAM TURBINE AND A CONDENSER

[75] Inventor: René Bozec, Drancy, France

[73] Assignee: Alsthom, Cedex, France

[21] Appl. No.: 873,883

[22] Filed: Jun. 13, 1986

[30] Foreign Application Priority Data

Jun. 14, 1985 [FR] France ..... 85 09056

[51] Int. Cl.[4] ..... F01K 11/02

[52] U.S. Cl. ..... 60/692; 60/690

[58] Field of Search ..... 60/690, 692

[56] References Cited

U.S. PATENT DOCUMENTS 4,257,233 3/1981 Kaelber ..... 60/690 X 4,311,016 1/1982 Kaelber ..... 60/692 X

*Primary Examiner*—Allen M. Ostrager

*Attorney, Agent, or Firm*—Sughrue, Mion, Zinn, Macpeak and Seas

[57] ABSTRACT

A connection between a steam turbine (1) and a condenser (2), the turbine being supported by an admission end bearing (7) and by an exhaust end bearing (8), and exhausting axially into an end-located condenser via an exhaust sleeve (3) which is connected to the turbine stator at one end and which has its other end connected to the condenser via a sealed resilient connection (4), the turbine-condenser connection including the improvement whereby a tubular duct (44) passes freely through the condenser along the turbine axis, one end (45) of said duct being fixed to the fixed parts of the turbine exhaust end bearing, which parts are connected to said sleeve (3), and the other end (43) of said duct being connected to a flange (38) having the same diameter as the condenser end of the exhaust sleeve, with a sealed resilient connection (39) being provided between the periphery of said flange and the condenser.

3 Claims, 4 Drawing Figures

CONNECTION BETWEEN A STEAM TURBINE AND A CONDENSER

The present invention relates to a connection between a steam turbine and a condenser.

More particularly, the invention relates to axially exhausting turbines having an end-connected condenser. A suitable connection must be provided between the turbine and the condenser while allowing for relative expansions and contractions therebetween without unwanted effects on the turbine which could lead to misalignment and deformation which would prevent the steam turbine from operating properly.

BACKGROUND OF THE INVENTION

A prior disposition consists in the turbine exhaust sleeve being conncted to the condenser by means of an expansion bellows allowing for relative differences in vertical expansion between the condenser and the turbine to be absorbed. The condenser is free to move longitudinally along the axis of the turbine and forces due to atmospheric pressure urging the condenser towards the turbine are compensated by means of hinged buttresses disposed in parallel with said bellows connecting the exhaust sleeve to the condenser.

However, this disposition does not eliminate all of the forces applied to the turbine: when the turbine expands, it pushes against the condenser via said buttresses and needs to overcome considerable friction force in condenser reaction to said thrust; in addition, the condenser's connection pipework also reacts against the turbine during such displacements.

Preferred embodiments of the present invention avoid relative expansion between the turbine and the condenser from applying reaction forces from the condenser against the turbine.

SUMMARY OF THE INVENTION

The present invention provides a connection between a steam turbine and a condenser, the turbine being supported by an admission end bearing and by an exhaust end bearing, and exhausting axially into an end-located condenser via an exhaust sleeve which is connected to the turbine stator at one end and which has its other end connected to the condenser via a sealed resilient connection, the turbine-condenser connection including the improvement whereby a tubular duct passes freely through the condenser along the turbine axis, one end of said duct being fixed to the fixed parts of the turbine exhaust end bearing, which parts are connected to said sleeve, and the other end of said duct being connected to a flange having the same diameter as the condenser end of the exhaust sleeve, with a sealed resilient connection being provided between the periphery of said flange and the condenser.

Thus, by virtue of the invention, the condenser no longer applies any reaction against the turbine either in a vertical direction or in a horizontal direction. In addition, this disposition provides the additional advantage of enabling the exhaust end turbine bearing to be inspected by providing access along the axial duct which is open to the atmosphere, whereas in the prior disposition such access required bearing inspection ducts to be provided radially through the exhaust sleeve, thereby impeding steam flow.

In a preferred embodiment of the invention, said turbine includes an axially fixed point situated level with its admission end bearing. It is also preferable for the condenser to be fixed to the ground.

Condenser expansion then takes place relative to a transverse key.

BRIEF DESCRIPTION OF THE DRAWINGS

An embodiment of the invention is described by way of example with reference to the accompanying drawings, in which.

MORE DETAILED DESCRIPTION

Figure 1:
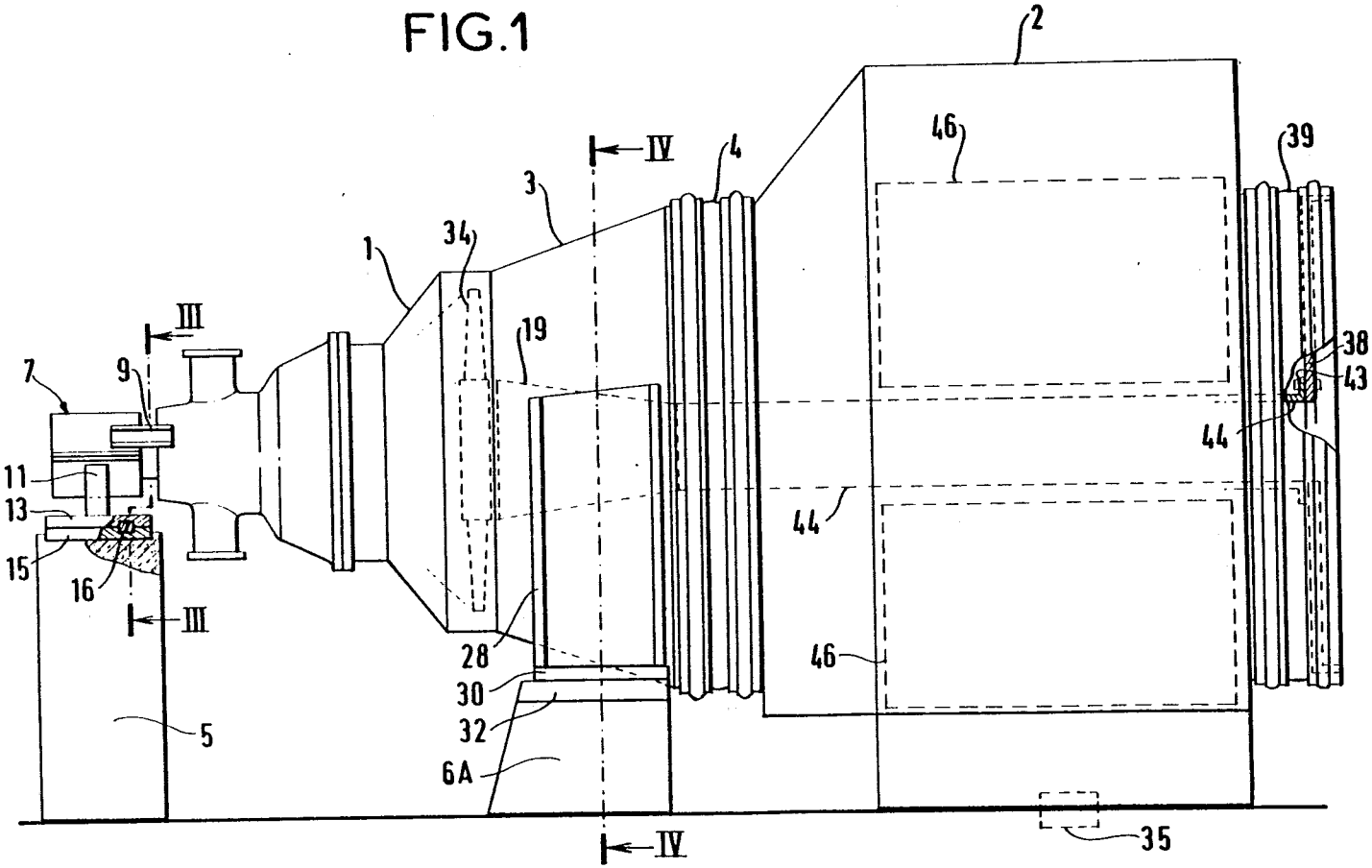
FIG. 1 is an elevation view of an assembly comprising an axial turbine and a condenser mounted at the end thereof.

With reference to the figures, the assembly shown comprises an axial turbine 1 and a condenser 2 which is situated axially beyond a turbine exhaust sleeve 3 and which is connected to the sleeve by means of a sealed resilient connection 4.

The turbine 1 is supported on a single concrete block 5 supporting a bearing 7 at its admission end, and a pair of concrete blocks 6A and 6B supporting a bearing 8 at its exhaust end and located inside the exhaust sleeve 3.

The admission end bearing 7 is rigidly connected to the body of the turbine by beams 9 and 10, and it stands on the block 5 via legs 11 and 12 which are terminated by feet 13 and 14 resting on a sole plate 15 which is anchored in the block 5.

The axial position of the turbine at its admission end is fixed by transversely mounted keys 16 and 17.

The exhaust end bearing 8 is rigidly connected by support arms 18 to an internal ring 19 which is itself supported inside the exhaust sleeve 3 by arms 20. The exhaust sleeve 3 is fixed to the body of the turbine 1 by means of a flange 21.

Figure 2:
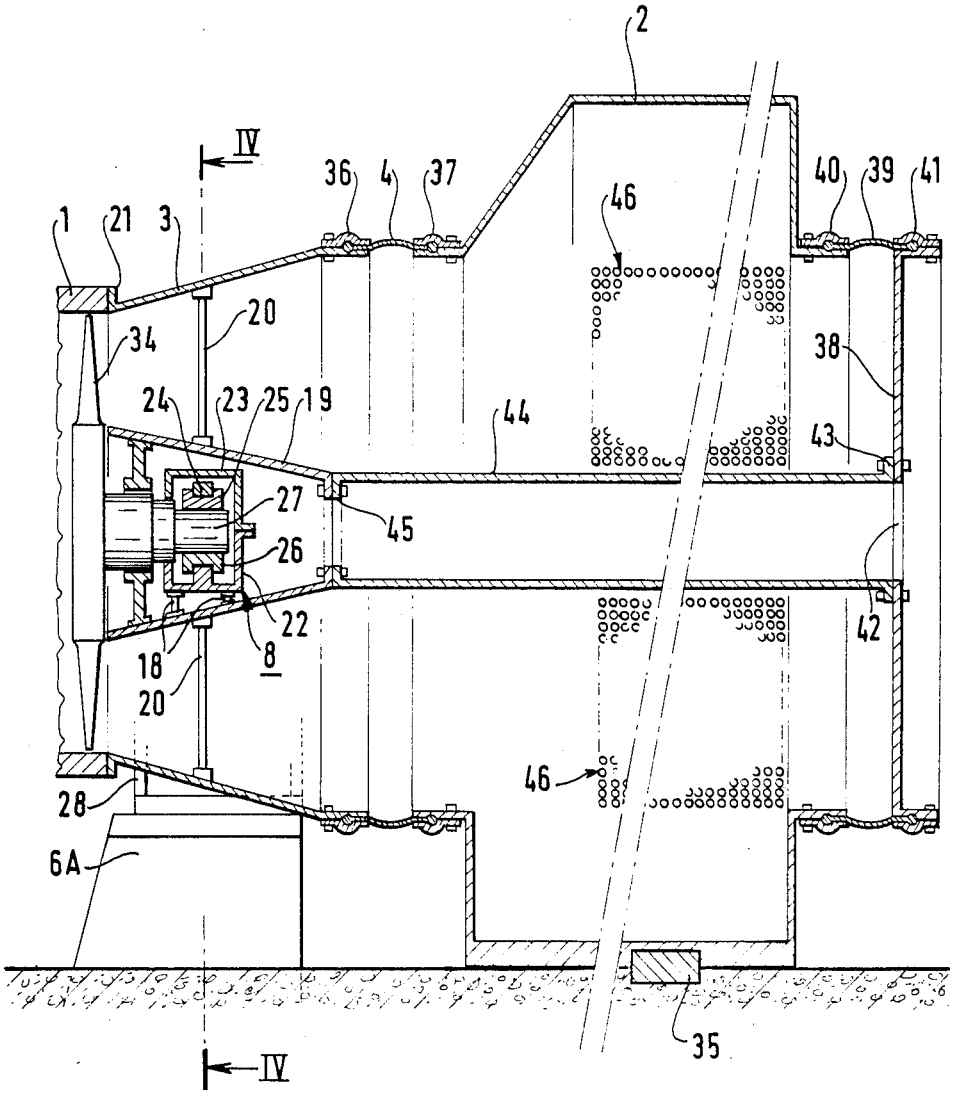
FIG. 2 is an axial section through a portion of the assembly shown in FIG. 1.
Figure 3:
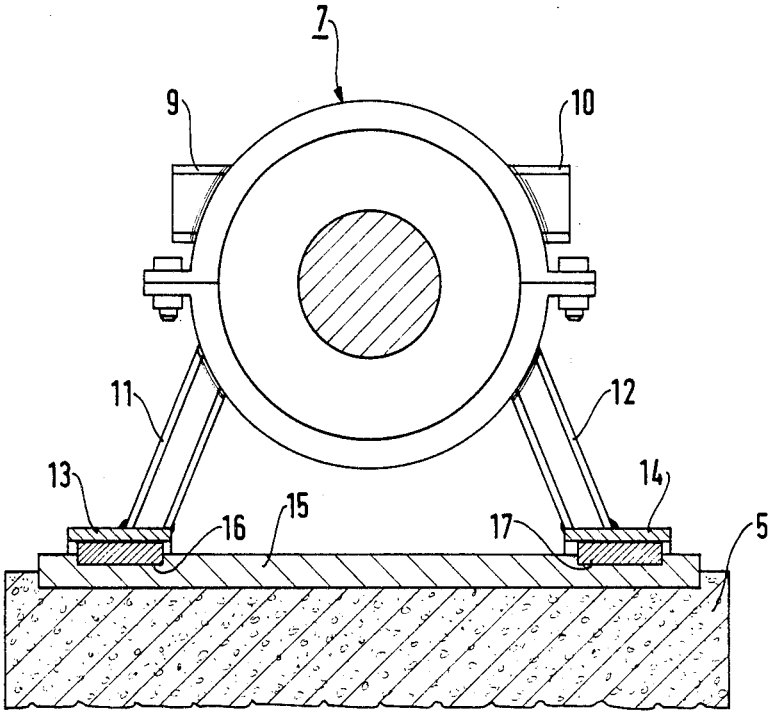
FIG. 3 is a cross-section on line III—III of FIG. 1.
Figure 4:
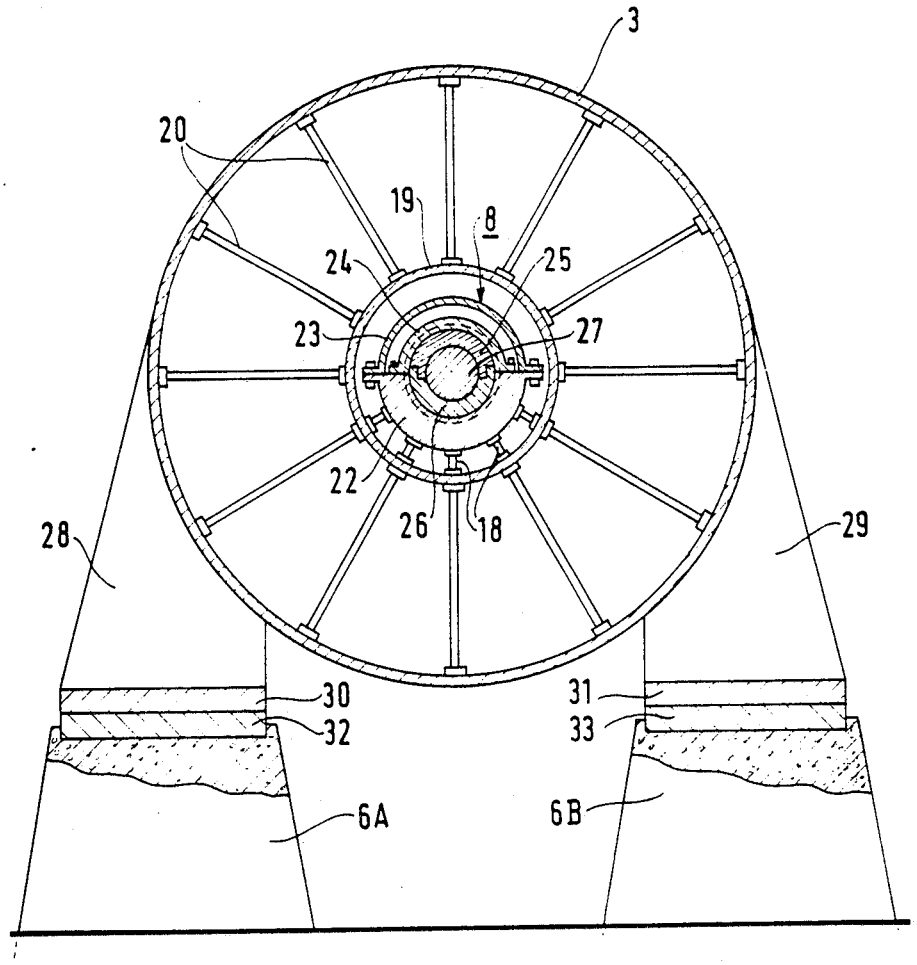
FIG. 4 is a cross-section on line IV—IV of FIGS. 1 and 2.

FIGS. 2 and 4 show the exhaust end bearing 8 in greater detail. It comprisees a bearing body 22, a cover 23, and a clamp 24 which holds and lower bearing bushes 25 and 26 in place. Reference 27 indicates the turbine rotor shaft. At the exhaust end, the turbine is supported (as can be seen in the figures) via its bearing 8 and legs 28 and 29 terminated in feet 30 and 31 which rest freely on sole plates 32 and 33 anchored in the blocks 6A and 6B, respectively. The turbine is not axially fixed at its exhaust end and it may expand and contract freely, with the feet 30 and 31 being free to slide over their corresponding sole plates.

FIGS. 1 and 2 show the last set of rotor blades 34 in diagrammatic form. The condenser 2 is connected to the ground by any means suitable for fixing its position, e.g. by means of a transverse key 35 leaving the condenser free to expand and contract on either side thereof.

As mentioned above, the condenser 2 is connected to the exhaust sleeve 3 by means of a sealed resilient connection 4 which is clamped between jaws 36 and 37.

The other end of the condenser is open and it is connected to a flange 38 by means of a second sealed resilient connection 39 which is similarly clamped between jaws 40 and 41. The flange 38 has a circular orifice 42 having one end 43 of a tubular duct 44 fixed thereto, with the tubular duct extending along the axis of the turbine and running through the entire length of the condenser so that its opposite end 45 is fixed to the internal ring 19. The duct 44 passes between two bundles 46 of tubes. The first purpose of the duct 44 is to compensate forces due to atmospheric pressure acting on the outside of the turbine and urging it towards the condenser 2. Thus, by virtue of its connection to the flange 38 having the same diameter as the diameter of the upstream end of the exhaust sleeve 3 which is subjected to atmospheric pressure on its outside face only, the duct 44 serves to exert a counteracting force on the fixed portions of the turbine.

Thus, by virtue of the invention, the condenser and the turbine are completely mechanically decoupled by virtue of the connections 4 and 39 enabling them to expand and contract relative to one another both vertically and axially, with the forces due to atmospheric pressure being compensated via the flange 38 and the duct 44 and the parts fixed to the bearing 8 which is connected to the exhaust sleeve 3 and thus to the turbine stator. The supports are thus not subjected to any forces due to atmospheric pressure.

The duct 44 also provides additional advantages. In particular, it gives access to the exhaust end bearing 8 without requiring the turbine body to be disassembled and without requiring access shafts to be provided radially through the sleeve 3. Steam flow is thus not hindered. The ducts can also be used to pass oil and steam pipes.

What is claimed is:

1. A connection between a steam turbine and an end-located condenser, said turbine including an axial shaft, a turbine stator about said shaft, said shaft being supported by an admission end bearing and by an exhaust end bearing, said exhaust end bearing including fixed parts, said turbine exhausting axially into said end-located condenser via an exhaust sleeve which is connected to said turbine stator at one end and which has its other end connected to the condenser via a sealed resilient connection, the turbine-condenser connection including the improvement comprising a tubular duct passing freely through the condenser coaxial with the turbine shaft, means fixing one end of said duct to the fixed parts of the turbine exhaust end bearing, said fixed parts being connected to said sleeve, and a flange connected to the other end of said duct said flange having the same diameter as the condenser end of the exhaust sleeve, and a sealed resilient connection provided between the periphery of said flange and the condenser.

2. A turbine-condenser connection according to claim 1, wherein said turbine includes an axially fixed point situated level with its admission end bearing.

3. A turbine-condenser connection according to claim 1, wherein the condenser is connected to the ground via a transverse key.

* * * * *